United States Patent [19]

Nakano et al.

[11] Patent Number: 4,716,392

[45] Date of Patent: Dec. 29, 1987

[54] POWER SUPPLY SWITCH

[75] Inventors: Kunimitsu Nakano; Hiroyuki Onishi, both of Kadoma, Japan

[73] Assignee: Matsushita Electric Works, Ltd., Japan

[21] Appl. No.: 827,144

[22] Filed: Feb. 7, 1986

[51] Int. Cl.[4] ..... H01H 3/00

[52] U.S. Cl. ..... 335/189; 335/191; 335/21; 335/6

[58] Field of Search ..... 335/189, 190, 191, 6, 335/14, 20, 15, 21, 22; 337/70, 75, 71

[56] References Cited

U.S. PATENT DOCUMENTS

| | | | |
|---|---|---|---|
| 3,806,848 | 4/1974 | Harper | 335/191 |
| 4,376,270 | 3/1983 | Staffen | 337/70 |
| 4,514,709 | 4/1985 | Nakano | 335/201 |
| 4,598,263 | 7/1986 | Heyne | 335/20 |

*Primary Examiner*—E. A. Goldberg
*Assistant Examiner*—Lincoln Donovan
*Attorney, Agent, or Firm*—Stevens, Davis, Miller & Mosher

[57] ABSTRACT

A power supply switch wherein a contact operating member pivotably supported at its middle is coupled at one end to an end of a spring link and at the other end to an end of a tension spring, the spring link is coupled at the other end substantially to the center of a movable contactor which carrying on one end a movable contact for engaging with and disengaging from a fixed contact as well as the other end of the tension spring, and the movable contactor is formed to have on the other end a latch part to which a latch member is engageable as operatively associated with a bimetal plate for tripping the latch member to disengage it from the latch part, whereby the switch is made to break the contacts specifically upon detection of any excessive current, while sufficiently minimizing the size of the entire switch and improving the operability with an effectively reduced spring load applied during rocking operation of the operating member.

12 Claims, 11 Drawing Figures

POWER SUPPLY SWITCH

TECHNICAL BACKGROUND OF THE INVENTION

The present invention relates to power supply switches and, more particularly, to power supply switches which include a mechanism for breaking power supply circuit in response to an excessive current flowing therethrough.

The power supply switch of the type referred to is effectively employed as built in various electrical apparatus and equipments for manually turning ON and OFF the power supply circuit while automatically breaking the circuit upon detection of any excessive current.

DISCLOSURE OF PRIOR ART

Known power supply switches have been arranged to incorporate therein a fuse, bimetal or the like means so that, in addition to normal contact making and breaking operation, the power supply could be thereby interrupted upon any excessive current beyond a rated level. In such switches, however, means responsive to the excessive current have had to be often prepared separately from make-and-break contact means to be incorporated in the electrical apparatus, so that their manufacturing and assembling works have been caused to be rather complicated and troublesome.

A typical one of devices responsive to such an excessively large current as a short-circuit current or an overcurrent for breaking the power supply circuit will be a circuit breaker, which generally includes a manual contact making and breaking mechanism so as to be utilized also as a power supply switch. While various circuit breakers have been suggested, as disclosed in U.S. Pat. No. 4,514,709 to K. NAKANO et al and in many others, they are not designed for the incorporation into the electrical apparatus and are too large in size and spring load to be adaptable to the incorporation. Accordingly, it has been demanded to improve the circuit breaker in many respects which have been rendering the breaker to be improper for being utilized as the power supply switch built in the electrical apparatus.

TECHNICAL FIELD OF THE INVENTION

A primary object of the present invention, therefore, to provide a power supply switch which is provided with the contact breaking function with respect to any excessive current, with the foregoing problems in the known switches eliminated and with the entire size sufficiently minimized, and is still improved in the operability with the spring load effectively reduced though imparted upon switch handle operation.

According to the present invention, this object can be attained by providing a power supply switch which comprises a housing, an operating member pivotably supported substantially at the middle to the housing for rocking motion as manually operated, a movable contactor provided at one end with a movable contact engageable with and disengageable from a fixed contact and at the other end with a latch part, means for linking between one end of the operating member and substantially the central part of the movable contactor, a tension spring engaged at one end to the other end side of the operating member and at the other end to the movable contactor at its position between the linking point of the link means and the one end having the movable contact, means engageable to the latch part of the movable contactor for latching the contactor into a position of engaging the movable contact with the fixed contact as the contactor is moved with a rotation of the operating member, with the linking point of the operating member to the link means shifted beyond a line connecting between the pivoting axis of the operating member and the linking point of the link means to the movable contactor, means engaged to the latch means for biasing it in a direction of engaging with the latch part of the movable contactor, and means engaged to the latch means for tripping the latch means out of its engaging position with the latch part against the force of the biasing means to forcibly break the contacts.

Other objects and advantages of the present invention shall be made clear in the following description of the invention detailed with reference to preferred embodiments shown in accompanying drawings.

Figure 1:
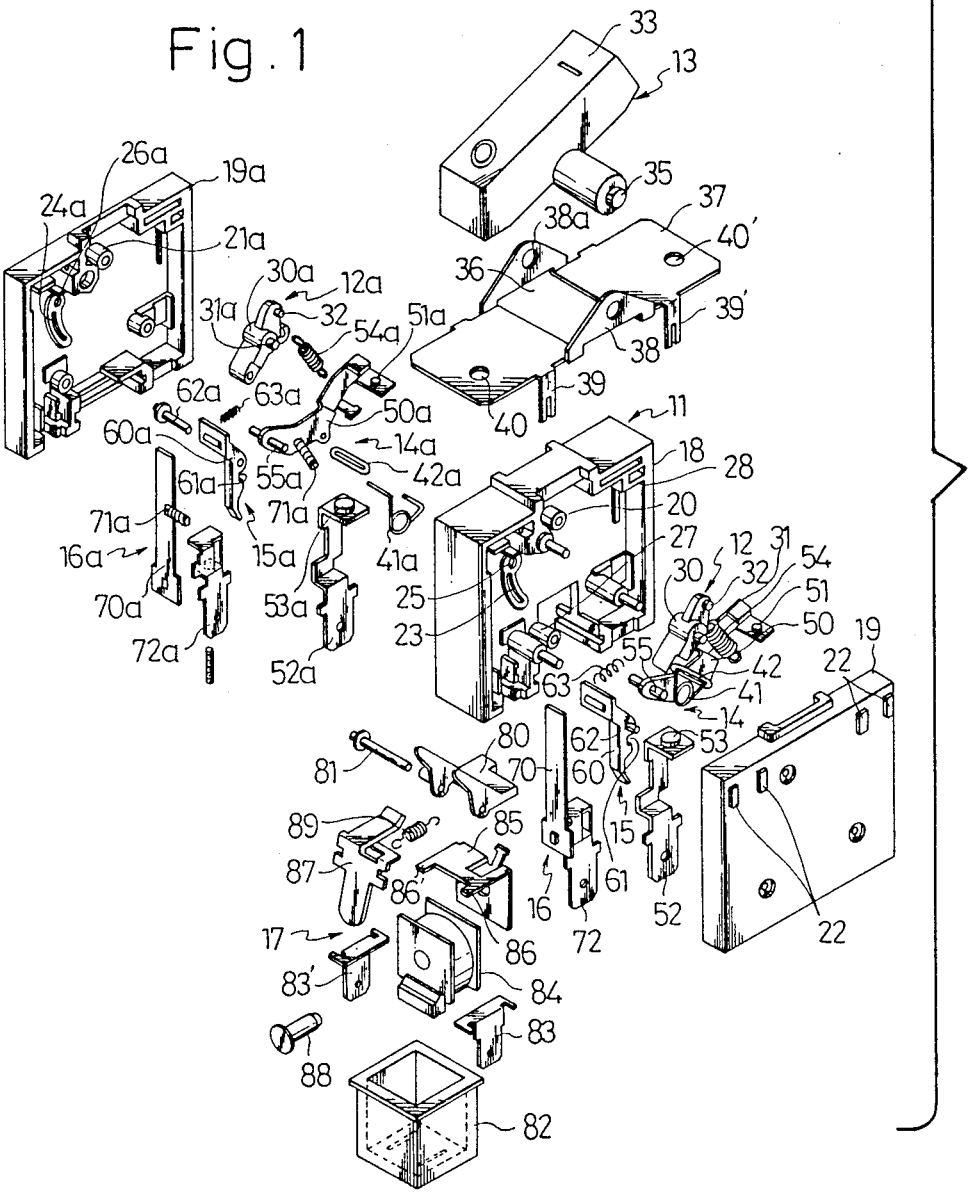
FIG. 1 is a perspective view, as disassembled substantially into all constituent members, of the power supply switch in an embodiment of a bipolar arrangement according to the present invention.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

DISCLOSURE OF PREFERRED EMBODIMENTS

Figure 3:
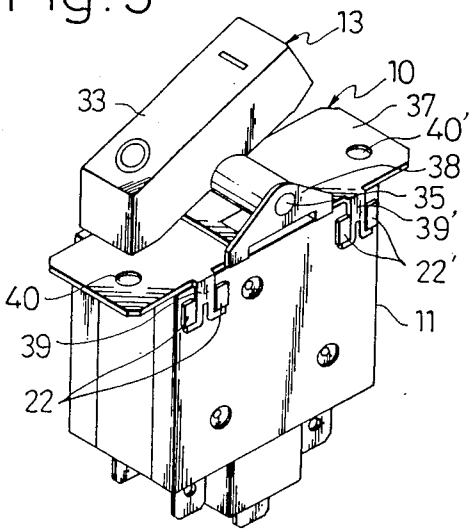
FIG. 3 is a perspective view of the power supply switch of FIG. 1 shown as assembled.
Figure 2:
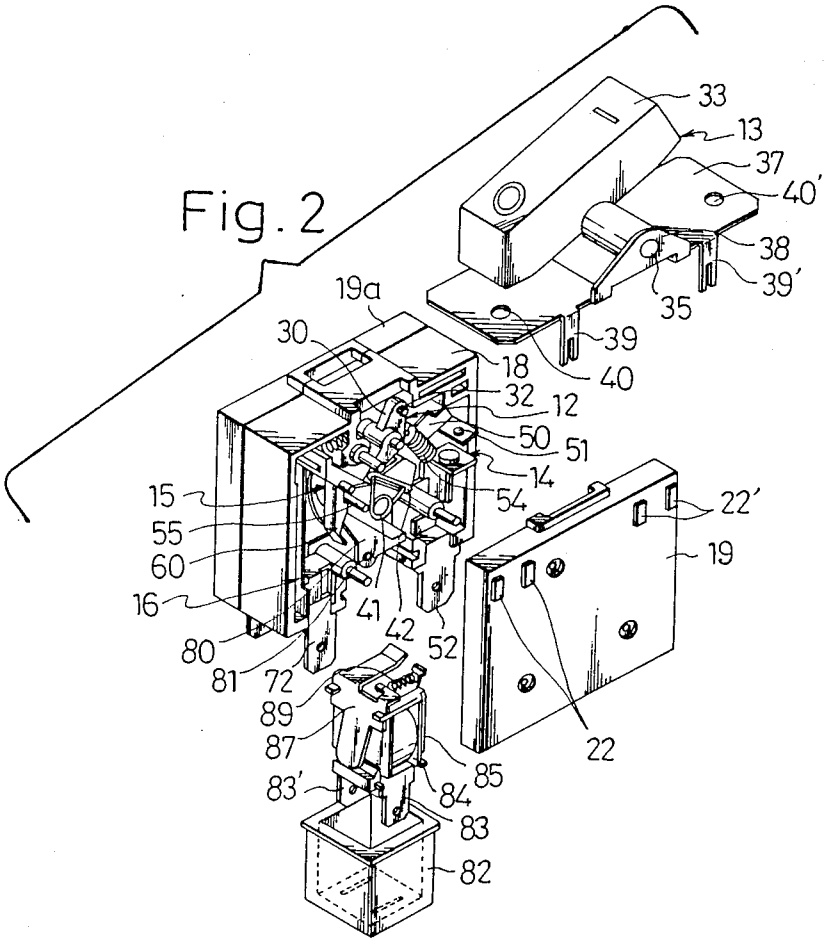
FIG. 2 is a perspective view of the power supply switch of FIG. 1 shown in an intermediate stage of its assembling work.

Referring to FIGS. 1 to 3, there is shown a power supply switch 10 of a bipolar type, i.e., having two pairs of make-and-break contacts. The switch 10 generally comprises a housing 11 for accommodating therein most of following constituents respectively provided in two sets, operating means 12 and 12*a* to which a rocking means 13 mounted onto the housing 11 is engageable in common, make-and-break contact means 14 and 14*a*, latching means 15 and 15*a* operatively associated with the operating means and make-and-break contact means to be shiftable into a tripped state, excessive current response means 16 and 16*a* operatively associated with the latching means for shifting them to the tripped state when an excessive current flows through the switch 10, and a remote control means 17 also for shifting the latching means to the tripped state in response to an externally provided electrical signal therefor. More specifically, the housing 11 comprises a central housing part 18 opened on both sides of a central partition, and two side housing parts 19 and 19*a* respectively disposed on each opened side of the central housing part 18 to define an accommodation chamber, as coupled to the central housing part 18 preferably by pressingly inserting a plurality of coupling pins provided on the central housing part 18 into associated pin-receiving bosses provided in the side housing parts 19 and 19*a* and desirably welding them. In this case, most of constituent members of each set of the operating means 12 and 12*a* as well as those of each set of the contact means 14 and 14*a* are arranged in each of the accommodation chambers in mirror symmetry with respect to the partition of the central housing part 18 and are operated substantially in the same manner with each other. Accordingly, their explanation shall be made in the followings only with reference to one side of the central housing part 18 including references to arrangements of corresponding parts of the housing 11, and thus the same members on the other side of the central housing part 18 as those on the one side explained are illustrated as denoted by the same reference numerals but with the suffix "a" added.

Referring now more in details to the power supply switch 10, the operating means 12 includes a rocker 30 having three arms extended in three different directions and pivotably supported substantially at the center by a supporting shaft 31 held by opposing shaft receiving parts 20 and 21 of the central and side housing parts 18 and 19. One of the arms upwardly extended of the pivoting element 30 acts as a linkage projection 32 coupled to an operating handle 33 forming a part of the common rocking means 13, as shiftably engaged in a slidable slit of a linkage arm 34 (see FIG. 7) extended downward from the handle 33 into the interior of the housing 11 through a central slit in the upper wall of the housing 11. The handle 33 is provided with a rotary shaft 35 laterally extended and, as required, with a mark or characters applied to the top face for visualizing the mark or break state of the contact means 14. The rotary shaft 35 is rotatably fitted to upwardly extruded pivot lugs 38 and 38*a* of a mounting plate 37 having a central opening 36, and is mounted onto the top faces of the central and side housing parts 18, 19 and 19*a*. More specifically, the mounting plate 37 is provided at its side edges with fixing legs 39 and 39' each extended downward to have forked ends which are bent in separating directions as engaged to each of pairs of fixing lands 22 or 22' provided on the side housing parts 19 and 19', whereby the three divided parts of the housing 11 are integrally coupled together by the mounting plate 37, as shown specifically in FIGS. 3 and 6. Further, the mounting plate 37 is formed to have screw holes 40 and 40' made adjacent both longitudinal ends for mounting the switch 10 of the present invention to a piece of electrical equipment not shown. It will be appreciated that, with the foregoing arrangement, clockwise or counterclockwise rocking of the handle 33 about the rotary shaft 35 causes the linkage arm 34 extending through the opening 36 of the mounting plate 37 and further through the slit of the housing 11 into the interior thereof to be rotated in the same direction, whereby the rocker 30 is rocked in a direction opposite to the rotation of the handle 33 about the support shaft 31 with the linkage projection 32 of the rocker 30 slid in the slot of the linkage arm 34.

Now, a second arm extended downward of the rocker 30 of the operating means 12 on a side of the shaft 31 opposite to the foregoing first arm (seen best in FIG. 7) is linked to one of a pair of resilient leg parts extended from a circular middle part as mutually spaced by a predetermined angle, while both the leg parts of the spring link 41 are engagedly inserted in an elongate ring 42 for restricting resiliently separating angle of the leg parts to a predetermined value corresponding to the length of the ring 42. The spring link 41 is also linked at the other leg part substantially to the central part of a movable contactor 50 forming a part of the make-and-break contact means 14. On the lower face of a lug piece laterally extended at a rearward end of the movable contactor 50, a movable contact 51 is secured for engaging with or disengaging from a fixed contact 53 on the upper face of a laterally extended lug part of a fixed contactor 52 secured in the vicinity of a rearward end wall of the housing 11 as held between the central and side housing parts 18 and 19 preferably by means of at least one of raised and recessed portions formed on wall surfaces of the accommodation chamber defined by the both housing parts, so as to downwardly extend out of the housing 11. A tension coil spring 54 is engaged at one end to the movable contactor 50 at a position between the central part to which the other leg part of the spring link 41 is linked and the rearward end carrying the movable contact 51 and at the other end to the relatively small third arm extended rearward of the rocker 30.

The other forward end of the movable contactor 50 carries a latch pin 55 extended at both ends laterally out of both sides of the contactor and engaged slidably in opposing arcuate guide grooves 23 and 24 respectively provided in the inner walls of the central and side housing parts 18 and 19, while the latch pin 55 is also engaged at a portion on one side along the contactor in a recess 61 formed in the rearward edge of a latch arm 60 forming a part of the latching means 15. The latch arm 60 is pivotably supported by a shaft 62 provided substantially to the middle portion and engaged in opposing shaft supporting portions 25 and 26 of the central and side housing parts 18 and 19, so that clockwise rotation of the latch arm 60 about the shaft 62 will allow the latch pin 55 of the movable contactor to disengage from the recess 61 of the latch arm 60. A compression spring 63 is provided between the top end of the latch arm 60 and a proper engaging base formed as expanded from the inner wall of the housing, so as to normally urge the latch arm 60 into engagement with the latch pin 55, i.e., in the counterclockwise direction. Disposed to oppose the latch arm 60 on the forward side is a bimetal plate 70 forming a part of the excessive current response means 16, and this bimetal plate 70 is electrically connected through a braided wire 71 to the movable contactor 50 so that, upon the flow of an overcurrent through the switch, the bimetal plate 70 will bend at the upper end and abut against the upper end of the latch arm 60 and rotate it in the clockwise direction against the urging force of the spring 63. The bimetal plate 70 has at its lower end an integral terminal plate 72 secured to the housing in the vicinity to a forward end wall of the housing as held between the central and side housing parts 18 and 19 preferably by means of at least one of raised and recessed portions formed on the wall surfaces of the accommodation chambers defined by the both housing parts.

The latch arm 60 is engaged at its lower part to one of a pair of arms extended obliquely forwardly from a central body part of an actuator 80 forming a part of the remote control means 17 disposed to act in common to the both sides of the bipolar arrangement. This actuator 80 is pivotably supported by a shaft 81 born at the center as passed through a bearing hole 27 in the partition of the central housing part 18 and engaged at both ends in pivoting holes made substantially in the center of the actuator. When the actuator 80 is rotated counterclockwise in FIG. 7, the oblique arm of the actuator 80 causes the latch arm 60 rotated clockwise against the force of the spring 63, so as to have the latch pin 55 of the movable contactor 50 disengaged from the latch arm 60.

The remote control means 17 comprises an electromagnet unit 84 housed in a casing 82 which is fixed to the housing with the upper edge flange fitted in a central mounting recess formed in the lower walls of the central and side housing parts 18 and 19. The electromagnet unit 84 comprises a pair of control terminals 83 and 83' led out of the casing 82, a yoke 85 having pivot lugs 86 and 86', an armature 87 pivotably held by the lugs 86 and 86' substantially at the central part of a generally L-shape in side view of the armature, and a core 88 disposed horizontal as coupled at one axial end to the yoke 85 and opposed at the other end to a downward extended leg of the L-shaped armature 87 for its attraction upon excitation by a coil wound on the core, while the other upper leg extended rearward of the armature 87 is brought into engagement with the lower surface of the central body part of the actuator 80 and coupled to an end of a tension spring 89 secured at the other end to the yoke 85 so that the armature 87 will be normally biased to separate the downward leg of the armature 87 from the core 88. With this arrangement, an external control signal current fed to the terminals 83 and 83' causes the downward extended leg of the armature 87 to be electromagnetially attracted to the core 88 against the force of the tension spring 89, and the upper leg of the armature 87 thus counterclockwise rotated about the pivot lugs 86 and 86' of the yoke 85 urges the actuator 80 to rotate also counterclockwise.

Figure 6:
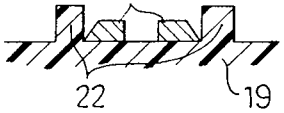
FIG. 6 is a fragmentary cross sectional view as magnified at one of the coupling parts between a mounting plate for a rocking means and a housing in the switch of FIG. 1.
Figure 4:
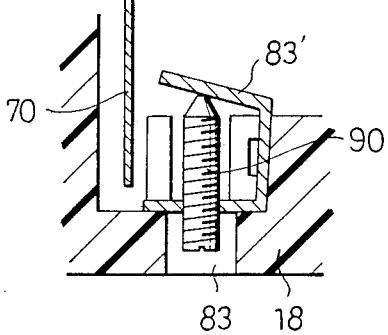
FIG. 4 is a fragmentary vertically sectioned view as magnified of a mounting arrangement for an excessive current response section in the switch of FIG. 1.
Figure 5:
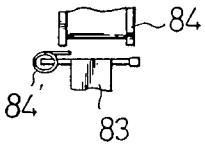
FIG. 5 is a fragmentary vertically sectioned view as magnified of a lead-out arrangement for a coil included in an electromagnet means in the switch of FIG. 1.

In the foregoing arrangement, upward movement of the movable contactor 50 upon breaking operation of the contact means 14 is stopped by means of a corner projection 28 or the like made within the housing 11 for abutment thereto at the contaot-carrying rearward end of the movable contactor 50 and, consequently, it is desirable to flatly expand the upper edge of the rearward end of the movable contactor 50 in its width direction. In the excessive current response means 16, further, the upper part of the terminal plate 72 is extended desirably to form a lateral U-shape as seen best in FIG. 4 or 7, the upper leg portion 83' of which extension is made to have a downward extended arm 83'' for intergrally securing thereto the base part of the bimetal plate 70 by engaging a projection of the arm 83'' into a slit of the bimetal plate 70, while allowing the upper leg portion 83' of the lateral U-shape to be adjustably bendable together with the arm 83'' as well as the bimetal plate 70 by means of a screw 90 screwed through a threaded hole in the other lower leg portion of the lateral U-shaped extension to engage at the top end of the screw 90 with the upper leg portion 83' so that, with the screw 90 driven upward or downward, the upper leg portion 83' will bend upward or downward to decrease or increase the distance between the bimetal plate 70 and the latch arm 60, that is, to vary a set value of the responsive excess current. In electrically connecting the terminal 83 with the coil of the electromagnet unit 84, it is preferable that a lead-out end 84' of the coil is wound on a lug of the terminal 83 as seen in FIG. 5. In securing the mounting plate 37 to the housing 11, it is preferable to increase coupling force between the fixing legs 39 of the plate and the fixing lands 22 and 22' on the side housing part 19 by sharpening side edges of the legs 39 to be tapered for positive engagement with opposing edges of the lands, as shown in FIG. 6.

The operation of the power supply switch 10 of the present invention shall now be explained briefly. In the contact breaking state of the make-and-break contact means 14 as in FIG. 7, a manual rotation of the handle 33 of the rocking means 13 in the clockwise direction in the drawing will result in the making state of the contact means 14 shown in FIG. 8. That is, the clockwise rotation of the handle 33 causes the rocker 30 to be rotated counterclockwise about the shaft 31 through the linkage arm 34 against the force of the tension spring 34, whereby the coupling point P1 between the downward extended arm of the rocker 30 and the spring link 41 is moved to pass the line connecting the shaft 31 and the coupling point P2 between the spring link 41 and the movable contactor 50, whereupon the connecting line which represents the linking distance between the rocker 30 and the contactor 50 becomes longer and, therefore, the movable contactor 50 is caused to rotate downward about the latch pin 55 latched to the latch arm 60 as a fulcrum, so that the movable contact 51 of the contactor 50 will come into engagement with the fixed contact 53. As a result, an electric path for energizing the associated equipment of the power supply switch 10 is formed through the fixed contactor 52, thus engaged contacts 51 and 53, movable contactor 50, braided wire 71, bimetal plate 70 and terminal plate 72. In this contact making state, the coupling point P1 has passed the connecting line between the shaft 31 and the coupling point P2, or a so-called dead point, whereby the resilient force of the tension spring 54 even expanded here is made not effective to return the movable contactor 50 in a direction of disengaging from the fixed contactor 52, whereas the spring link 41 which is now slightly compressed in the ring 42 is made effective to resiliently urge the movable contactor 50 in downward rotating direction, providing thus a contacting force between the movable and fixed contacts 51 and 53, and the contact means 14 is stably kept in the contact making state.

Figure 7:
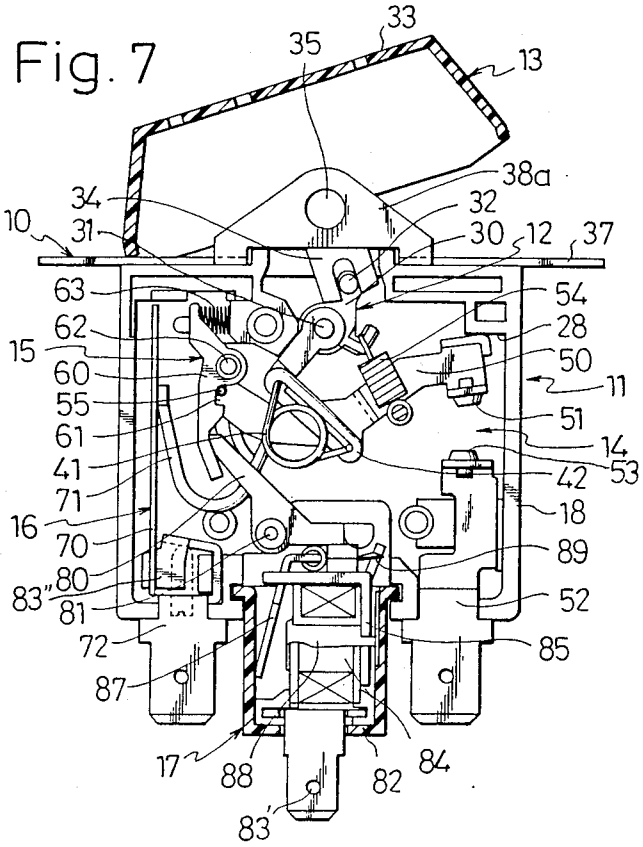
FIG. 7 is a side elevation with a side housing part removed for showing the interior of the switch of FIG. 1 in its contact breaking state.
Figure 8:
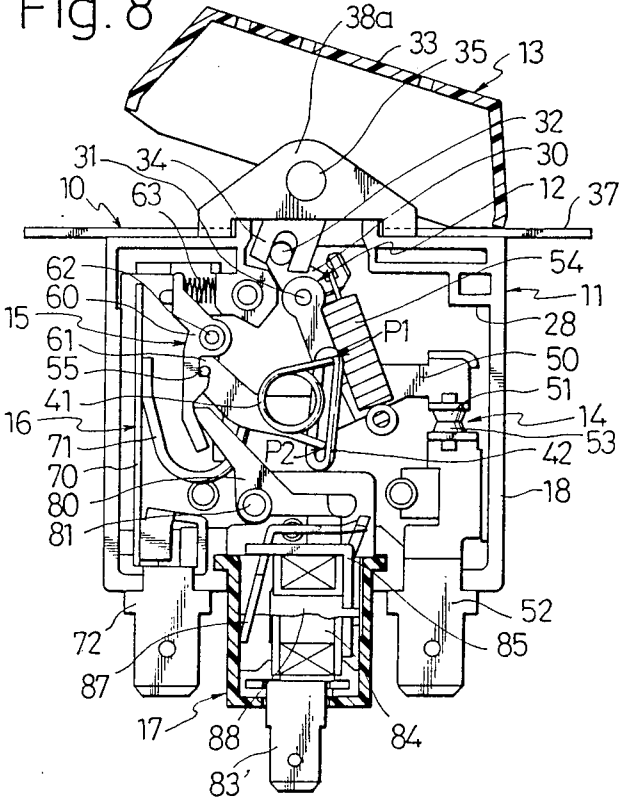
FIG. 8 is a side elevation similar to FIG. 7 of the switch of FIG. 1 but shown in its contact making state.

When the handle 33 is rocked reversely counterclockwise from the state of FIG. 8, an operation opposite to the above is established and the make-and-break contact means 14 is shifted from the contact making state of FIG. 8 to the contact breaking state of FIG. 7.

Figure 9:
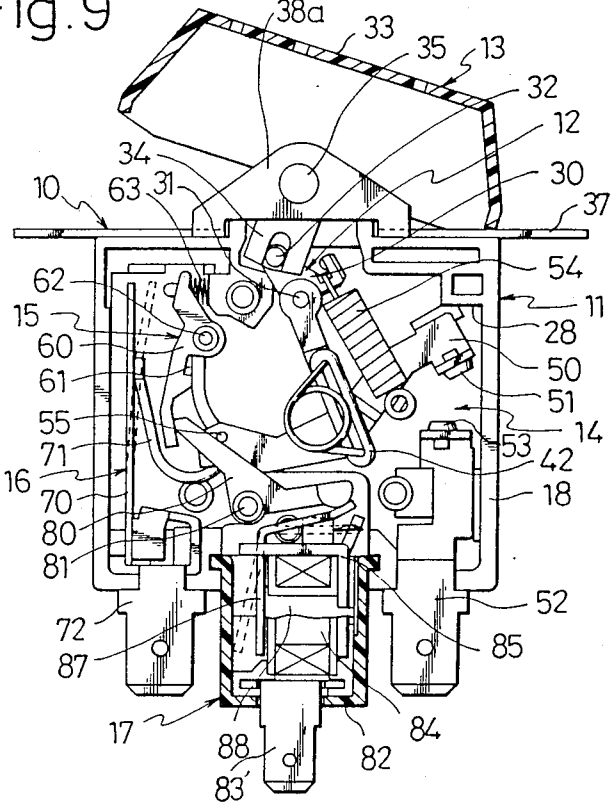
FIG. 9 is a side elevation also similar to FIG. 7 of the switch of FIG. 1 but shown in its tripped state of the contacts.

Assuming now that, in the contact making state of the switch as in FIG. 8, an excessive current has happened to flow through the formed electric path. Here, the bimetal plate 70 in the excessive current response means 16 is thermally caused to gradually bent into such a position as shown by a dotted line in FIG. 9, upon which the upper part of the latch arm 60 is pushed rearwardly by the bent plate 70 against the force of the spring 63 to rotate clockwise about the shaft 62, and the latch pin 55 of the movable contactor 50 is tripped from the engaging recess 61 of the latch arm 60. With the latch pin 55 thus tripped, the fulcrum for the contact making rotation of the movable contactor 50 is lost and, here, the resilient force of the spring link 41 slightly compressed in the state of FIG. 8 is made effective to slightly rotate the linking point P2 of the contactor 50 anticlockwise about the linking point P1 of the link 41, causing the tripped latch pin 55 to move downward along the arcuate guide grooves 23 and 24, so as to substantially align the shaft 31 and the both linking points P1 and P2 on a straight line, whereupon the resilient force of the tension spring 54 that has been expanded is immediately made effective to quickly rotate the contactor 50 anticlockwise about the linking point P2 as a fulcrum, separating forcibly the movable contact 51 from the fixed contact 53 to reach such tripped state as shown in FIG. 9. During the downward movement of the latch pin 55, in the above, the pin hits the extended arm of the actuator 80 to rotate it about the shaft 81, whereby the contact making state on the other pole side in the mirror symmetry with the above described pole side is simultaneously tripped in the same manner as above.

In an event when the external remote control signal is provided from an external control means to the electromagnet unit 84 through the control terminals 83 and 83' in the contact making state of FIG. 8, the core 88 is magnetized to attract the downward extended leg of the armature 87, and the upper leg of the armature 87 thus rotated about the pivot lugs 86 and 86' pushes up the central body part of the actuator 80 to rotate it counterclockwise about the shaft 81 to the position shown by solid lines in FIG. 9. With this rotation of the actuator 80, its obliquely forwardly extended arm urges the lower part of the latch arm 60 to move forwardly against the force of the pushing spring 63 to have the latch arm 60 rotate clockwise about the shaft 62, whereby the latch pin 55 is tripped from the engaging recess 61 of the latch arm 60 and the contact means 14 is forcibly tripped from the contact making state of FIG. 8 to the tripped state of FIG. 9 in the same manner as in the case of the excessive current. Since the actuator 80 operates in common to the other pole side, the contact means 14*a* in the mirror symmetry to the contact means 14 is also simultaneously shifted to the tripped state.

The tripped state of FIG. 9 may be released in such well known manner as has been employed, for example, in circuit breakers, or by manually shifting up the latch pin 55 of the movable contactor 50 provided to extend to the exterior of the housing 11.

The power supply switch of the present invention may be modified in various ways. While the foregoing explanation has been made with respect to the case of bipolar type, for example, the arrangement may be of single-pole type with all of the operating means, contact means, latching means and excessive current response means provided respectively in a single assembly. In this connection, it will be readily appreciated that the central housing part of the housing may be omitted and the housing, rocking means and remote control means may be made smaller in the thickness as adapted to the single-pole arrangement.

Figure 11:
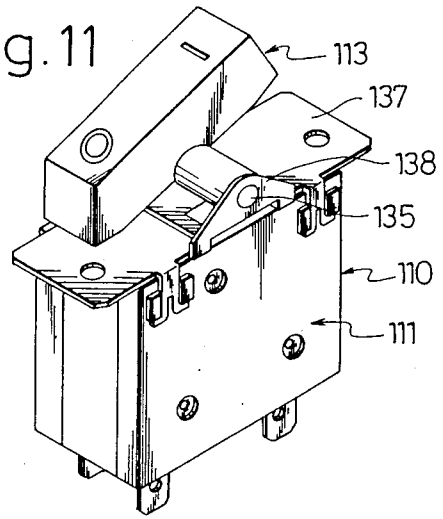
FIG. 11 is a perspective view as assembled of the power supply switch of FIG. 10.
Figure 10:
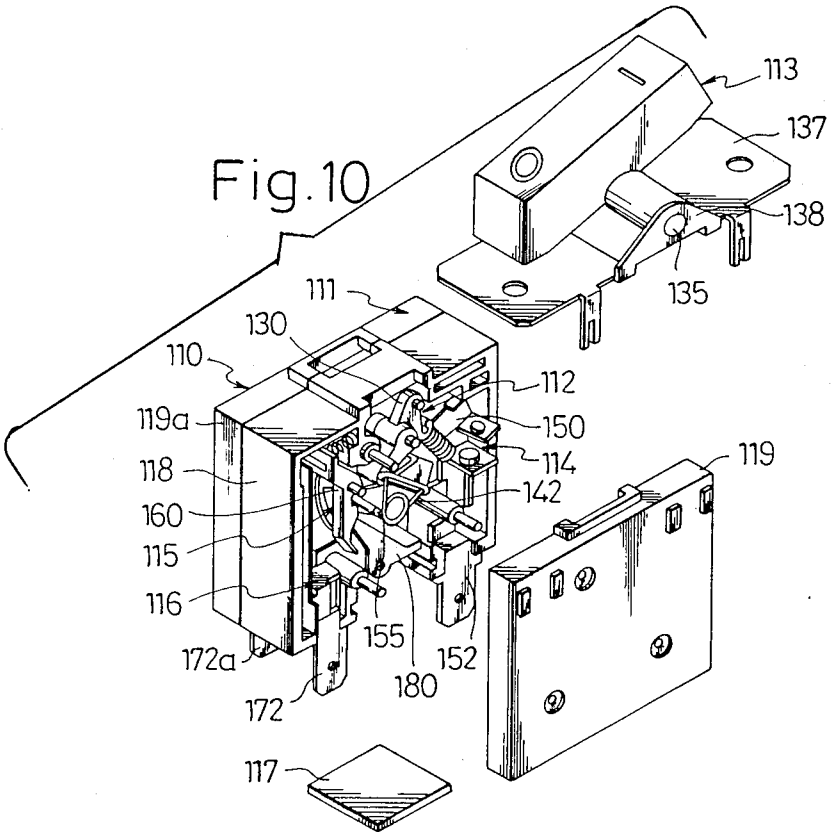
FIG. 10 is a perspective view in another embodiment of the power supply switch of the bipolar arrangement according to the present invention, as shown in its intermediate state of assembling work.

When the foregoing external remote control is unnecessary, further, the remote control means can be omitted as shown in FIGS. 10 and 11, wherein the main members are denoted by the same reference numerals but added by 100. In this case, other constituent elements than the actuator 180 of the remote control means in the foregoing embodiment are omitted, and a cover plate 117 is fittingly mounted to an aperture left in the center of the bottom walls of the central and side housing parts 118, 119 and 119*a*. Other arrangement and operation are substantially the same as those of the foregoing embodiment except for the remote control means.

What is claimed as our invention is:

1. A power supply switch comprising a housing, an operating member pivotably supported substantially at the middle of said housing, a movable contactor provided at one end with a movable contact engageable with and disengageable from a fixed contact and at the other end with a latch part, resilient means for linking between one end of said operating member and substantially the central part of said movable contactor, a tension spring engaged at one end of the movable contactor to the other end of the operating member and at the other end to the movable contactor at a position between the linking point of said link means and said one end having said movable contact of said movable contactor for biasing the movable contactor in a direction of disengaging from said fixed contact, means engageable with said latch part of the movable contactor for latching the contactor into a contact closing position of engaging the movable contact with said fixed contact as the contactor is moved with a rotation of the operating member, with the linking point of the operating member to the link means shifted beyond an imaginary line connecting between the pivoting axis of the operating member and said linking point of the link means to the movable contactor said resilient linking means being slightly compressed in said contact closing position of the movable contactor for providing thereto a contact pressure to the fixed contact, means engaged with said latch means for biasing it in a direction of engaging with said latch part of the movable contactor, and means engaged with the latch means for tripping the latch means out of engaging position with the latch part against the force of said biasing means to forcibly break the contacts.

2. A switch according to claim 1, wherein said resilient link means comprises a spring link having a pair of resilient legs respectively coupled to each of said operating member and movable contactor, and an elongated ring member for movably engaging therein said pair of legs of said spring link.

3. A switch according to claim 1, wherein said tripping means comprises an excessive current response means electrically connected to said movable contactor.

4. A switch according to claim 1, wherein said tripping means comprises a remote control means actuatable in response to an external control signal.

5. A switch according to claim 3, wherein said housing comprises a central housing part and a pair of side housing parts coupled to both sides of said central housing part, and said operating member, movable contactor, resilient link means, tension spring and latch means are provided respectively in pair for bipolar arrangements, each of said pairs of said members being housed on each side of said central housing part in mirror symmetric relationship to each other.

6. A switch according to claim 5, wherein said excessive current response means is disposed to be in common to said bipolar arrangements and comprises means for interlocking said latch means in both of the bipolar arrangements to each other.

7. A switch according to claim 4, wherein said housing comprises a central housing part and a pair of side housing parts coupled to both sides of said central housing part, and said operating member, movable contactor, link means, tension spring and latch means are provided respectively in pair for bipolar arrangements, each of said pairs of said members being housed on each side of said central housing part in mirror symmetric relationship to each other.

8. A switch according to claim 7, wherein said remote control means comprises an electromagnet unit disposed to be in common to said bipolar arrangements and including means operably engaged to an armature included in said electromagnet unit for interlocking said latch means in both of the bipolar arrangements to each other.

9. A switch according to claim 1, wherein said latch part of said movable contactor is slidably guided along an arcuate groove formed in said housing for defining motion of the movable contactor in relation to said link means upon said tripping for said forcible breaking of the contacts.

10. A switch according to claim 1, wherein a rocking member is interposed between said one end of said operating member and said link means, the linking distance between the operating member and said movable contactor being thereby made longer when the contactor is shifted into said contact closing position to make said biasing of said tension spring not effective to the contactor in that position.

11. A switch according to claim 1, wherein said tripping means comprises an excessive current response means electrically connected to said movable contactor, said housing comprises a central housing part and at least a pair of side housing parts coupled to both sides of said central housing part, and said operating member, movable contactor, link means, tension spring and latch means are provided respectively in pairs for at least bipolar arrangements, each of said pairs of said members being housed on each side of said central housing part in mirror symmetric relationship to each other, and said excessive current responsive means being disposed to be in common to said bipolar arrangements and comprising means responsive to the excessive current response means for interlocking said latch means in both of the bipolar arrangements to each other.

12. A switch according to claim 1, wherein said tripping means comprises a remote control means actuatable in response to an external control signal, said housing comprises a central housing part and at least a pair of said housing parts coupled to both sides of said central housing part, and said operating member, movable contactor, link means, tension spring and latch means are provided respectively in pairs for at least bipolar arrangements, each of said pairs of said members being housed on each side of said central housing part in mirror symmetric relationship to each other, and said remote control means comprising an electromagnet unit disposed to be in common to said bipolar arrangements and including means operably engaged to an armature included in said electromagnet unit for interlocking said latch means in both of the bipolar arrangements to each other.

* * * * *